United States Patent [19]

Saucedo

[11] 4,296,768

[45] Oct. 27, 1981

[54] PORTABLE DISHWASHER

[76] Inventor: Rudy E. Saucedo, 1508 Bahama Way, San Jose, Calif. 95122

[21] Appl. No.: 80,416

[22] Filed: Oct. 1, 1979

[51] Int. Cl.[3] ..... B08B 3/02

[52] U.S. Cl. ..... 134/47; 134/50; 134/57 DL; 134/81; 134/115 R

[58] Field of Search ..... 134/44, 47–48, 134/50, 52, 56 D, 57 D, 57 DL, 58 DL, 81, 115 R, 115 G

[56] References Cited

U.S. PATENT DOCUMENTS

| | | | |
|---|---|---|---|
| 2,063,746 | 12/1936 | Meeker | 134/58 DL |
| 2,722,941 | 11/1955 | Bartlett | 134/56 D X |
| 2,971,519 | 2/1961 | Willson | 134/115 R X |
| 3,075,215 | 1/1963 | Marue | 134/115 G X |
| 3,094,997 | 6/1963 | Nolte et al. | 134/81 X |
| 3,230,961 | 1/1966 | Benkert et al. | 134/115 R X |
| 3,385,306 | 5/1968 | Brater et al. | 134/179 X |
| 3,718,149 | 2/1973 | Mazza | 134/57 D |

FOREIGN PATENT DOCUMENTS

| | | | |
|---|---|---|---|
| 1628730 | 8/1971 | Fed. Rep. of Germany | 134/57 DL |

*Primary Examiner*—Robert L. Bleutge

*Attorney, Agent, or Firm*—Philip Furgang

[57] ABSTRACT

Disclosed is a limited use dishwasher which comprises a housing. Within the housing are a plurality of compartments for receiving dishes to be washed. Each compartment has a movable platform. Each platform is mechanically joined to a separate motor through the means of a lever arm. Conduits are provided to channel water and soap to each compartment and radiant drying is also provided in connection with each compartment. By inserting a dish within the compartment and pressing down on the platform, a switch is closed. Upon the closing of the entrance door to the dishwasher, a second switch is closed, which thereby couples the motor to a source of electrical energy. The motor causes the lever arm to move the platform upward during the washing cycle. Each motor is a rocker arm motor having an elliptical gear which engages the lever arm. On the gear are a series of bosses which contact and close switches at various points during the washing cycle. The switches, in turn, cause water and soap to be channeled to a preselected compartment. At the conclusion of the washing cycle, the drying cycle is turned on by switches. A table is provided around the outside of the washing unit for placement of controls and for other uses.

18 Claims, 7 Drawing Figures

PORTABLE DISHWASHER

BACKGROUND OF THE INVENTION

This invention relates to improvements in a kitchen article washing apparatus and, more particularly, to a dishwasher for washing dishes, cups, knives, forks, spoons, etc. found in a kitchen.

Automated devices for washing dishes are well known. Many attempts have been made to provide compact or limited use dishwashers. Such devices have been proposed with varying degrees of success. Thus, for example, a combined dining table and dishwasher is proposed by Willson in U.S. Pat. No. 2,971,519. Willson proposes a circular table having a large retainer beneath it. The retainer may be divided into a plurality of compartments, each with its own access door. Operatively connected to each door is a switch. Each of the switches is electrically connected in series. The device is so arranged so that when all the doors are closed, the dishwasher begins to operate. The various compartments, if not used to wash dishes, may be used for storage. This device has the disadvantage of not distinguishing between when dishes are merely stored and when they are to be washed. Apparently, the mere opening and closing of the door will start the unit working, unless the user of the dishwasher has previously shut off all the manual water valves. Furthermore, there is no way of selectively washing a small quantity of dishes or utensils except those which are stored in some predetermined compartment of the table. In addition, activation of the device is solely dependent upon the opening and closing of a door. This may inadvertently cause the dispensing of detergent, water, and the like.

In another device, proposed by Marue in U.S. Pat. No. 3,075,215, there is provided, in combination, an automatic dishwasher and table. The apparatus comprises a base portion enclosing the mechanical and electrical control elements of a dishwasher. The base portion supports a plurality of rotatable trays, which are latchable in either eating or washing positions. In order for this device to work as a dishwasher, however, the plates and utensils must be latched or locked to the table top. If the utensils or dishes come loose during the washing operation, they may be expected to fall in the washing apparatus and thereby become damaged or lost.

Another device is proposed by Brater et al. In U.S. Pat. No. 3,385,306, Brater et al. discloses a portable dishwashing machine which is but a smaller version of larger, standard devices. The device operates by receiving dishes and other utensils disposed in a removable holding basket, which is disposed on a filter screen and covered with a dome-type lid. While smaller than standard dishwashers, this device does wash a great many utensils and dishes at one time and has no facility for selectively washing small groups of dishes and utensils.

With general reference to the prior art, it appears, therefore, that there has not been proposed a convenient, efficient means for washing and cleaning a selective amount of dishes at one time.

SUMMARY OF THE INVENTION

It is an object of this invention to provide selected compartments for cleaning dishes and the like, so that a small number of such items may be selectively cleaned at one time.

It is another object of this invention to provide a limited use dishwasher which uses a minimum amount of energy and supplies to wash dishes and the like.

It is still another object of this invention to provide a small, efficient dishwasher which is simple and convenient in use and is economical to manufacture.

In accordance with the teachings of this invention, there is provided a dishwasher having a housing. The housing has a plurality of dish-receiving compartments. Means are provided within the housing for washing dishes so as to act upon dishes within the compartments. Means are provided within the housing for selectively coupling the washing means to at least one predetermined compartment. Means are also provided for operating the dishwasher upon the condition that the washing means is first coupled by the coupling means to the compartment.

A BRIEF DESCRIPTION OF THE DRAWING

DESCRIPTION OF THE PREFERRED EMBODIMENTS

One purpose of this invention is to provide a dishwasher in which only selected groups of utensils and dishes may be washed at any one time, at the discretion of the user.

Figure 1:
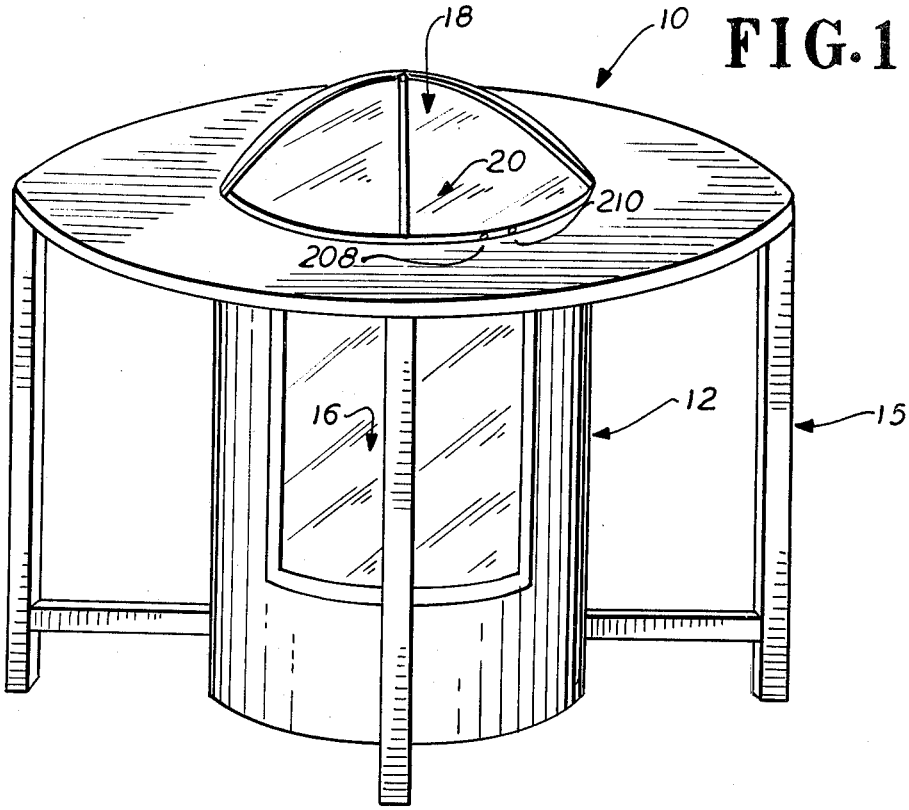
FIG. 1 is a perspective view of a dishwasher constructed in accordance with the teachings of this invention.

Turning to the drawing, there is provided a dishwasher 10 (FIG. 1). Preferably, the dishwasher comprises a lower housing 12. The dishwasher 10 may assume any desirable shape. However, in the context of this description, the lower housing 12 is a hollow cylindrical member made of any rigid material, such as high-impact plastic or metal. A bottom wall (not visible) closes the cylindrical side wall 16 of the lower housing 12. The upper end 18 (FIG. 2) of the housing 12 is open, providing access to the interior 20. Extending inwardly from the interior side 22 of the cylindrical side wall 16, at approximately one-half the distance between the upper end 18 and bottom wall, may be laterally extending mounting brackets 24.

A disc-shaped screen member 26 has, extending from its circumferential edge, laterally, extending brackets 28. The screen 26 is so dimensioned as to be disposed within the interior 20 of the lower housing 12. The brackets 28 of the screen 26 are so dimensioned as to be in registry with, and rest upon, the brackets 24 attached to the interior side 22 of the cylindrical side wall 16. As so disposed, the screen 26 and lower housing 12 may be secured by the mating brackets 28 and 24. It should also be noted that there will be a space between the screen 26 and the interior side 22 of the lower housing 12. The purpose of this space will be discussed more fully hereinafter.

A plurality of rod-like members 30, which may be made of any non-corrosive material, such as plastic or the like, is disposed vertically upon the screen 26. The screen 26 and the rod-like members 30 are so dimensioned so that one free end 32 of each rod 30 may be received through the mesh of the screen 26. Each rod-like member 30 has disposed at one end a washer or collar member 34, so that it will rest in a predetermined position upon the screen 26. The purpose of these rods 30 is to retain enclosures 36 in position. The function of these enclosures 36 will be more fully discussed hereinafter.

Figure 2:
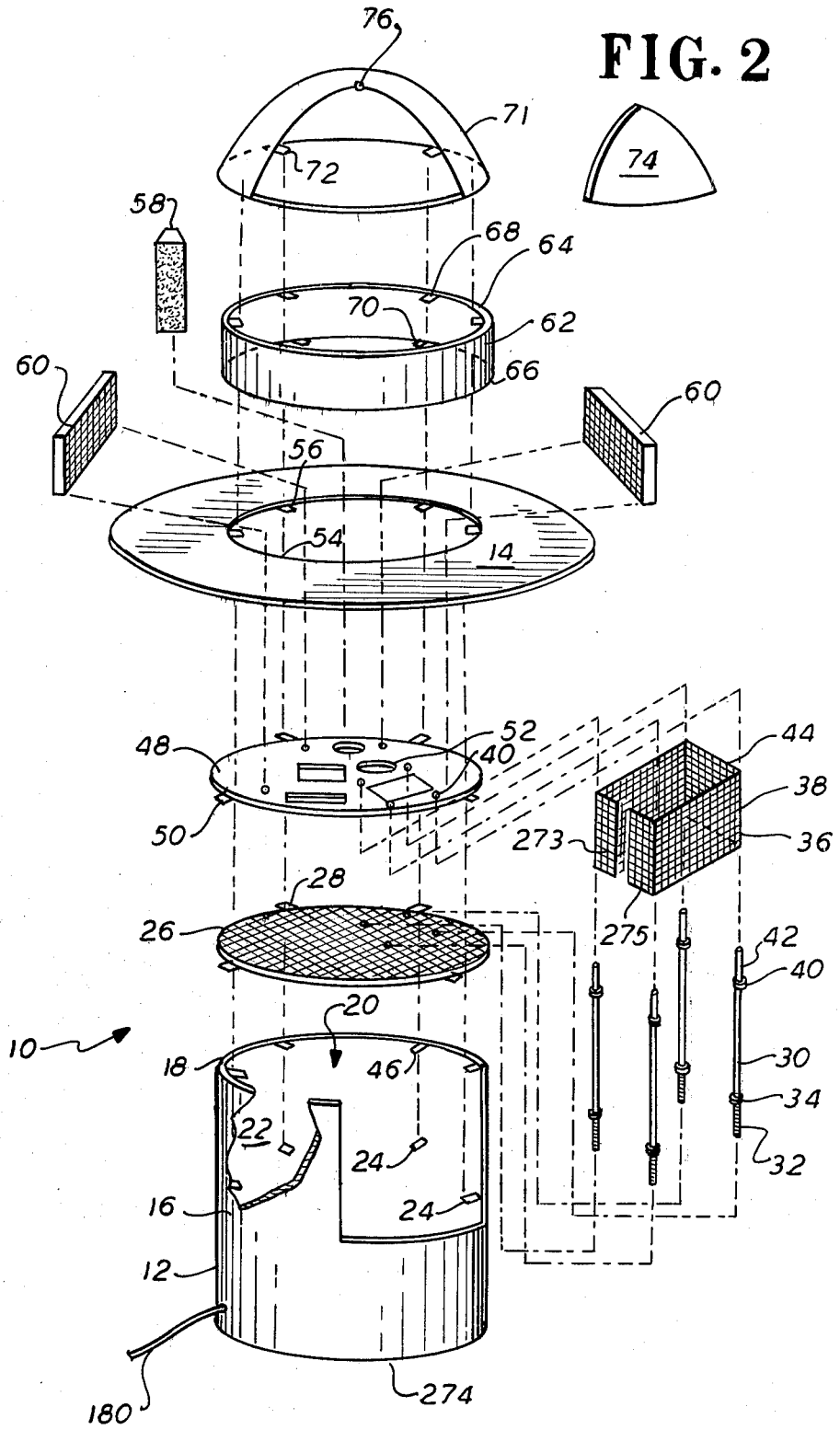
FIG. 2 is an exploded view of the dishwasher of FIG. 1, showing selected parts with indications of their relative position of assembly.

Each of the enclosures 36 is made of a screen-like material, such as plastic or metal. The side walls of each enclosure 36 are perpendicular to the horizontal screen 26. The rod-like members 30 serve as guides. Thus, for example, if the enclosure 36 is, as shown in FIG. 2, rectangular, guide posts or rod-like members 30 are disposed at each corner 38 of the enclosure 36 to retain the enclosure 36 in position upon the screen 26. A second washer 40 may be disposed at the upper end 42 of each rod 30, so as to grasp the top 44 of the enclosure 36. With all of the rods or guide bars 30 in place, the enclosure 36 will be held firmly in position.

It will be appreciated that the enclosure 36, as will be more fully discussed hereinafter, may take on different shapes.

The horizontal screen 26 is so disposed within the interior 20 of the lower housing 12, such that, with the vertical enclosure 36 disposed thereon, the top 44 of the enclosure 36 is substantially adjacent to the upper open end 18 of the cylindrical side wall 16.

Extending laterally inwardly from the interior side 22 of the side wall 16 at the upper end 18 may be a series of brackets 46. A disc-shaped, rigid dish-receiving member 48 is provided. This disc-shaped dish-receiving member 48 has, extending from its circumferential edge, laterally extending brackets 50. These brackets are in registry with the brackets 48 at the upper end 18 of the lower housing 12, so that when the dish-receiving member 48 is disposed upon the housing 12 with the brackets 50 upon the brackets 46, there is provided a convenient means of securing together the two members 48 and 12. These two may be joined—the screen 26 to the housing 12—by screws or other well-known joining means.

Each dish-receiving member 48 has, extending therethrough through, apertures 52. The apertures 52 have marginal edges of predetermined configurations and are intended to conform to aligned enclosures 36. Thus, the openings 52 may be so designed as to receive plates or spoons or cups, or the like, or any suitable combination thereof. In the example presented here, a rectangular enclosure 36 is in registry with a rectangular opening 52 in the member 48.

Disposed upon the open end 18 is a disc-shaped, horizontally disposed, laterally extending table top 14. The table 14 may be supported as by conventional legs 15. This table 14 may be made of any impact and rigid material, such as a metal or a plastic. It has a centrally disposed aperture 54, which generally conforms to the opening 18 of the end of the housing 12, and thereby serves to frame the dish-receiving member 48. Extending inwardly from the aperture 54 may be laterally extending brackets 56, which may be integrally formed with the table 52. These brackets 56 may be in registry with the brackets 50 of the dish-receiving member 48 and brackets 46 located at the upper end 18 of the lower housing 12, so that all three members may be joined at a common point. The brackets 56, 50, and 46 may be so dimensioned such that the table top 52 frames and encloses any space between the dish-receiving member 48 and the exterior wall 16 of the lower housing 12. The function of this table 52 will be discussed more fully hereinafter.

Disposed upon the horizontal screen 26, and adjacent to the interior side 22 of the cylindrical side wall 16 of the lower housing 12, may be, in addition to the enclosures 36, a bank of fans 58. These fans are well known in the art. Their function will be discussed more fully hereinafter.

In the same manner may be disposed a bank of heating elements 60, such as sun lamps or the like. These sun lamp banks or heating elements 60 are disposed upon the screen 26 and within the housing 12. The function of these heating elements 60 will be discussed more fully hereinafter.

A cylindrical thin-walled collar 62 may be disposed upon the table 14. The outer diameter of the collar 62 may generally conform to the interior diameter of the aperture 54 of the table 14. Extending inwardly at the upper and lower edges 64 and 66 of the collar 62 may be laterally and inwardly extending tab-like brackets 68 and 70, respectively. The lower brackets 70 may, in turn, be in registry with the brackets 56, 50, and 46 for common securing to the housing 12. A clear plastic dome 71 completes the outer housing of the dishwasher 10. The clear plastic dome 71 may have integrally formed, inwardly extending brackets 72 which are, in turn, in registry with the upper brackets 68 secured to the upper edge 64 of the collar by which the dome 71 may be secured to the collar 62. The dome 71 may be provided with a generally triangular or segment-shaped door 74, which provides access to the dish-receiving member 48. The door 74 may be hingedly secured to the remainder of the dome 71 by a small plastic hinge 76, constructed in a manner well known in the art.

Figure 3:
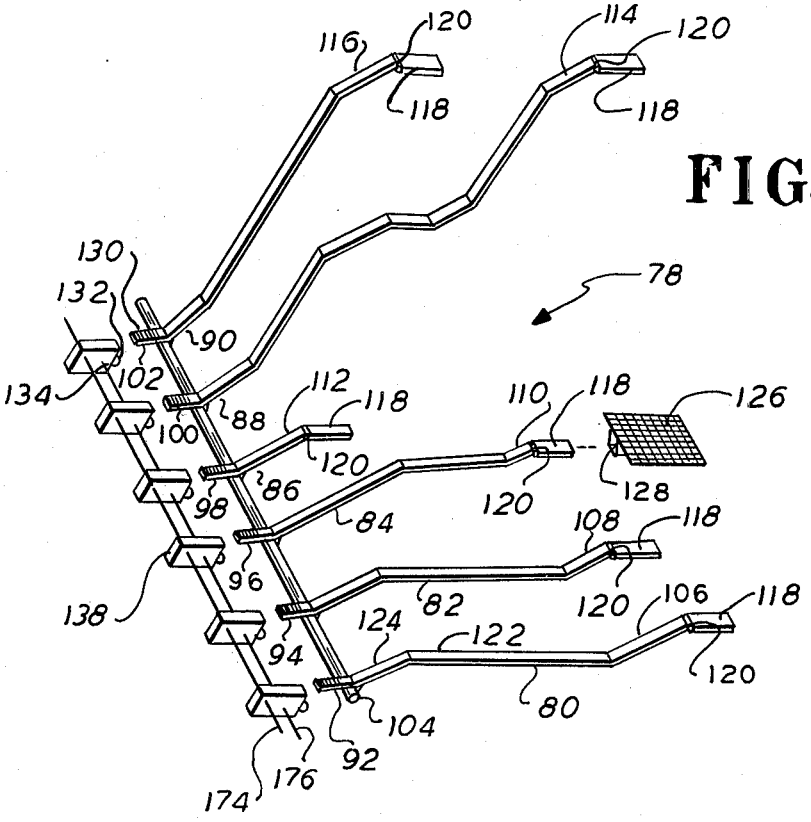
FIG. 3 is a perspective view of lever arms and ganged gears employed in the invention of FIG. 1.

Within the lower housing 12 and disposed between the horizontal screen 26 and the dish-receiving member 48 may be a lever arm assembly 78 (FIG. 3). The lever arm assembly 78 may comprise a number of lever arms, the purpose of which will be more fully discussed hereinafter. Thus, in the example shown, six lever arms—80, 82, 84, 86, 88, and 90—each having one end—92, 94, 96, 98, 100, and 102, respectively—are pivotally secured to a cylindrical rigid bar 104. The lever arms 80, 82, 84, 86, 88, and 90 and the bar 104 may be made of any rigid material—preferably, a stainless steel. It will be noted that each of the lever arms 80, 82, 84, 86, 88, and 90 have a rigid, angular configuration.

The respective ends 106, 108, 110, 112, 114, and 116, which are opposed to the pivotally mounted ends 92, 94, 96, 98, 100, and 102 of the lever arms 80, 82, 84, 86, 88, and 90 have hingedly secured thereto an enclosure-engaging base member 118. The hinge connection 120 may be made by any convenient means as is well known in the art. It is significant that the link 118 hingedly secured at 120 to each of the lever arms 80, 82, 84, 86, 88, and 90 be so secured that the hinge will not drop below a horizontal plane. Each of the arms 80, 82, 84, 86, 88, and 90, it will be noted, is comprised of a series of planar members (122 and 124, for example), each rigidly secured to one another. These lever arms 80, 82, 84, 86, 88, and 90 are angulated so they may reach a particular enclosure 36 within the housing 12.

At the base of each enclosure 36, and vertically slidable therewithin, may be a screen-like base member 126 (FIG. 3, not visible in FIG. 2). A wire-like bracket 128 is beneath the base so as to be engaged by the link 118. The purpose of the lever arms 80, 82, 84, 86, 88, and 90 is to raise and lower the base 126. It is for this reason that the link 118 must be hingedly mounted at 120 to the lever arms 80, 82, 84, 86, 88, and 90, respectively. For purposes of illustration, the base 126 is shown disconnected or separated from the link 118. However, in use, the link would be well within the bracket 128 and would only move in and out of the bracket slightly as the lever arms 80, 82, 84, 86, 88, and 90 move the base 126 from the lowermost point of the enclosure 36 to the upper end 42.

Figure 4:
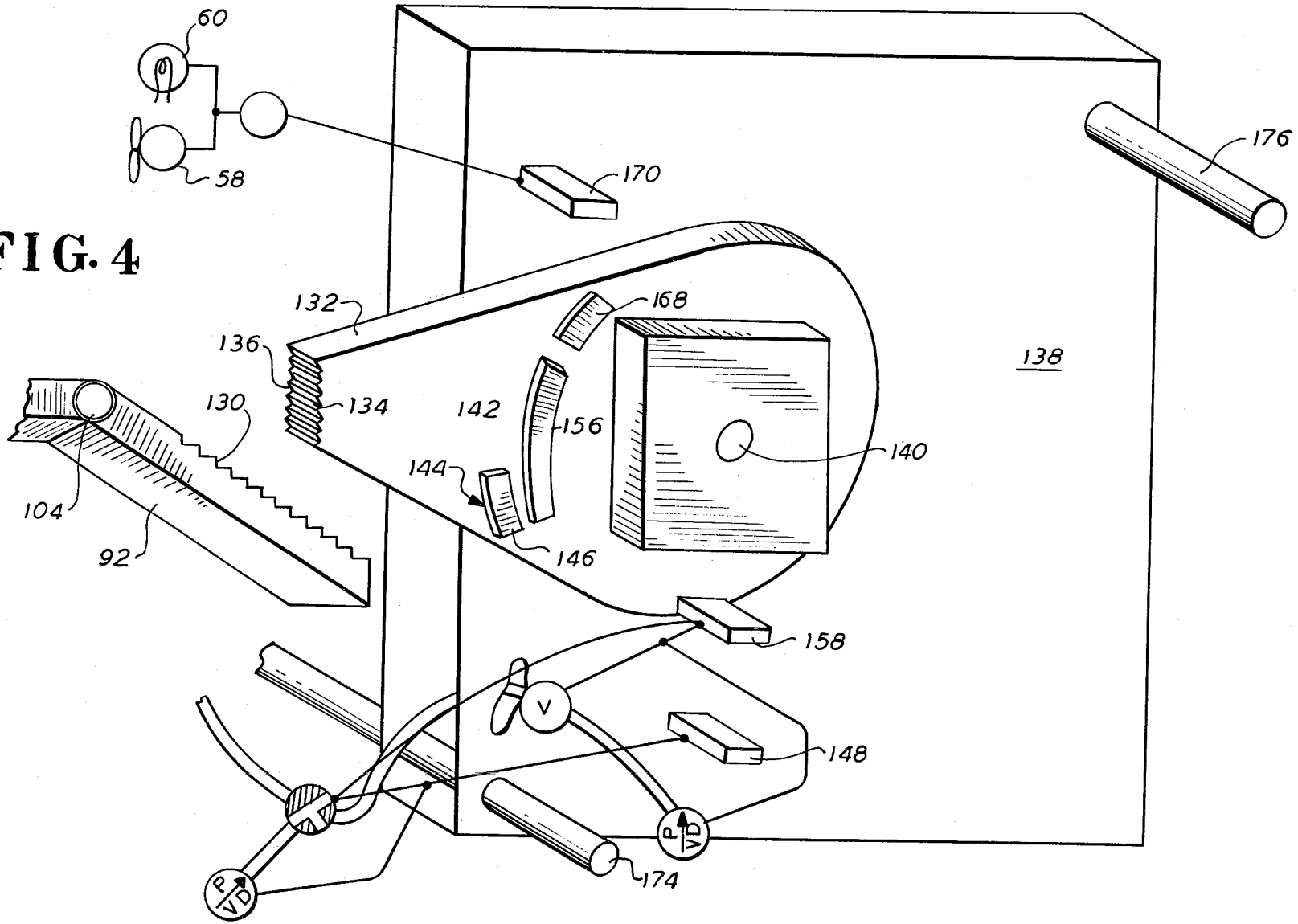
FIG. 4 is a schematic representation of one of the gears of FIG. 3.

The ends 92, 94, 96, 98, 100, and 102 of each of the lever arms 80, 82, 84, 86, 88, and 90, respectively, are provided with a series of linear gear teeth 130 (FIGS. 3 and 4).

Each of the free ends 92, 94, 96, 98, 100, and 102 of the lever arm 80, 82, 84, 86, 88, and 90, respectively, is so disposed as to have the linear teeth 130 of each engage a separately mounted, substantially elliptical gear 132 having at one apex end 134 a series of gear teeth 136. For purposes of example only and the ease of understanding, these gear teeth 130 and 136 have been shown out of engagement. In assembly, however, the gear teeth 130 and 136 are engaged. Each of the gears 136 is mounted upon a rocker arm motor 138. Rocker arm motors 138 are believed to be well known in the art. The gear 132 is mounted upon the armature 140 of the motor 138 so as to be rotated thereby. Along one side 142 of the gear 132 may be disposed bosses 144. It will be noted that these bosses 144 have varying lengths and are substantially arcuate. The purpose of these bosses 144 is to contact pressure-sensitive electrical switches and close them for predetermined periods of time. Thus, one of the bosses 146 is intended to contact and operate a first switch 148. In the same manner, a second boss 156 contacts a second switch 158. It will be noted that the second boss 156 is concentric with the first boss 146, but has a greater arcuate length, so that the switch 158 is turned on at substantially the same time as the first switch 148, but remains turned on for a longer period of time.

In a like manner, a third, arcuately extending boss 168 is intended to communicate with yet a third switch 170. The third boss 168 closes the third switch 170 after the first and second switches 148 and 158, respectively, are open. Thus, each motor 138 has associated with it a series of three switches 148, 158, and 170. The function of these switches will be more fully discussed hereinafter.

It is essential to note that the gear motors 138 are not interconnected. Rather, they are separately mounted for independent operation upon a pair of opposed mounting bars 174 and 176. These bars 174 and 176 are then secured to the lower housing 12 in a manner well known in the art.

Figure 7:
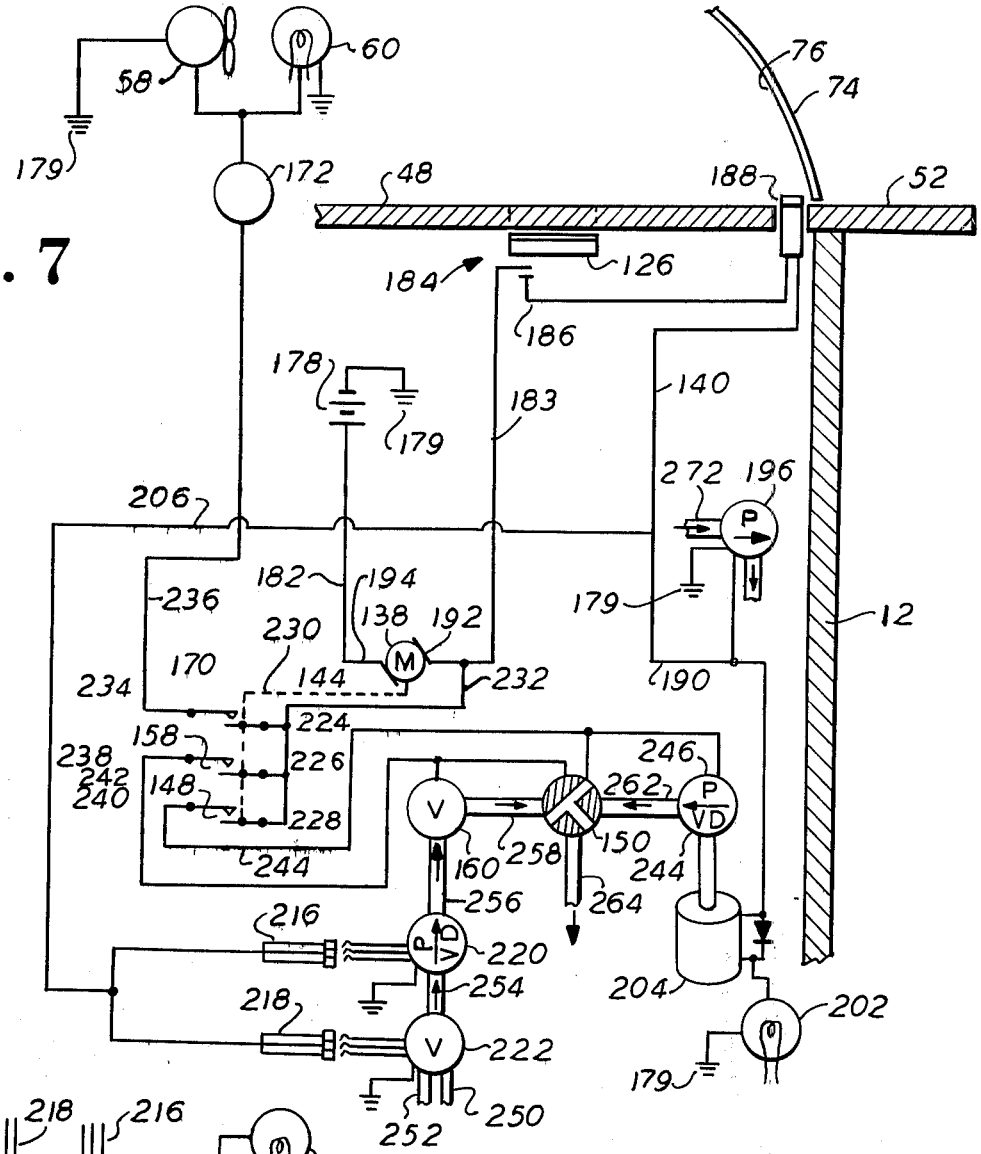
FIG. 7 is a schematic representation of the electrical system.
Figure 5:
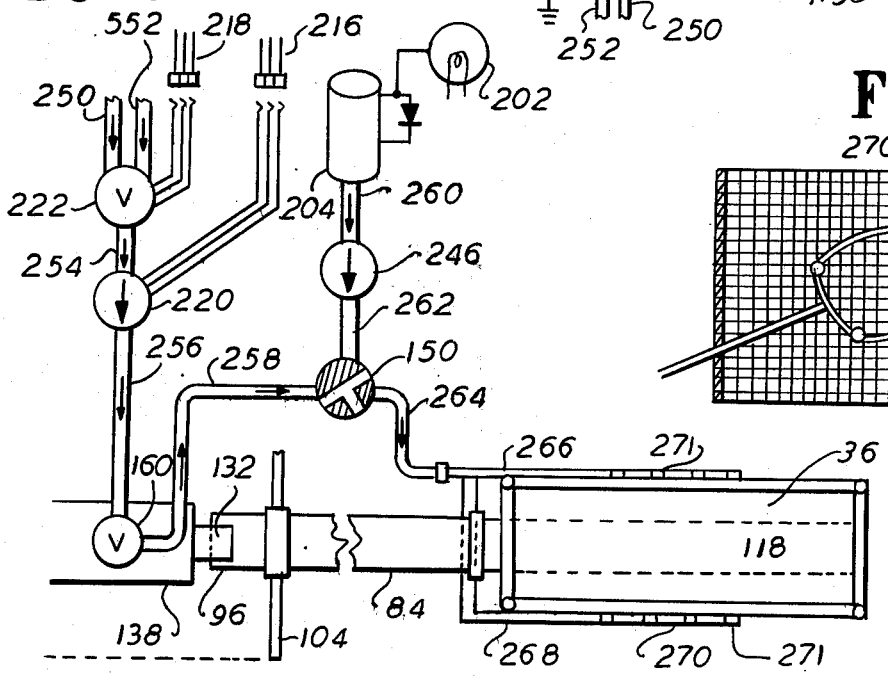
FIG. 5 is a schematic representation of the pump system.
Figure 6:
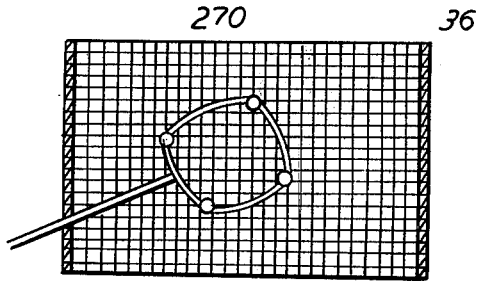
FIG. 6 is a side view of an appliance basket, having connected thereto one of the sprayer conduits.

A fuller understanding of the operation of this dishwasher 10 may be comprehended by first considering the electrical and hydraulic interconnections with reference to FIGS. 5, 6, and 7.

The dishwasher 10 may be supplied with a source of electrical power 178 which may, for example, be direct (as shown) or alternating current. The source of power 178 may be provided by means of any conventional source, such as a battery, or the like, and grounded as at 179. The choice of a source of power is one of convenience and for the purposes of explaining the operation of the dishwasher 10.

The source of power or B+ 178 is joined from a line 182 to one side 194 of each motor 138. Thus, one side 192 of all motors 138 are joined together and to the source of power 178. The other side 192 of each motor 138 is then coupled by a separate line 183 (only one motor 138 and line 183 are shown) to a platform switch 184 associated with one cleaning position or enclosure 36. The platform switch 184 is responsive to the position of the base 126 of the enclosure 36. The platform switch 184 is coupled in series to a pressure-sensitive door switch 188 in the door 74 by a line 186. There is only one door switch 188. Hence, all platform switches 184 are joined to this one door switch 188. The other side of the switch 188 is joined by lines 190 and 198 to a drain pump 196. The pump 196 is then joined to ground 179.

In addition, the line 190 is joined to an indicator light 202. The indicator light 202, in turn, is responsive to a level-sensing mechanism within a soap dispenser 204. Essentially, the indicating light 202 goes on when a float drops to a predetermined level, thereby closing a switch (not shown) within the soap dispenser 204, as is well known in the art. As a result, an indication is provided that the quantity of soap in the dispenser 204 is low. This indicator light 202 may be located on the table 14. The indicator light 202 is coupled to ground 179.

The other side of the door switch 188 may also be coupled by lines 190 and 206 to a pair of selector switches 216 and 218, respectively. One selector switch 216 may be coupled to a variable delivery pump 220, while the second switch 218 to a valve 222.

The second side 192 of the rocker arm motor 138, which is coupled by the line 183 to the platform switch 184, may also be coupled by line 232 to switch arms 224, 226, and 228. These switch arms 224, 226, and 228 are, in turn, the switch contacts of switches 170, 158, and 148, respectively, and are operative by the bosses 168, 156, and 146, respectively, on the gear face 142. The mechanical interrelationship between the motors 138 and the switches 170, 158, and 148 is indicated by the dashed line 230 (FIG. 7). The switch contact 234 of the switch 170 is connected by line 236 to a timer 172. The timer 172 is connected in series to the fans 58 and sun lamps 60, which are, in turn, coupled to ground 179. In a like manner, the contact 238 of the switch 158 is connected by line 240 to a three-way valve 150 and a valve 160. The switch contact 242 of the switch 148 is connected by a line 244 to the three-way valve 150 and a variable delivery pump 246.

The conduit connections may be more fully understood with further reference to the drawing (FIGS. 5 and 6) in which hot and cold water conduits 250 annd 252 are shown schematically connected to the valve 222. The valve 222 is connected by means of a conduit 254 to the variable delivery pump 220. The output of the variable delivery pump 220 is a manifold with one line for each cleaning station or enclosure 36. For ease of understanding, only one conduit 256 is shown. Thus, conduit 256 is connected to the valve 160. The valve 160 is connected by conduit 258 to one input port of the three-way valve 150. The liquid soap dispenser 204 is, in a like manner, connected by a conduit 260 to the other variable delivery pump 246. The output of the variable delivery pump 246 is a manifold with one line for each cleaning position or enclosure 36. For ease of understanding, one line 262 is shown. The output of the pump 246 is channeled by means of the conduit 262 to the other input port of the three-way valve 150. The output of the three-way valve 150 is connected to the conduit 264 and surrounds the retainer 36. Specifically, the conduit 264 branches off into two conduits 266 and 268, respectively. These conduits 268 and 266 each terminate in a circular tube 270. The circular tube 270 has a plurality of spray apertures 272 facing into the enclosure 36 so that water or soap passing through the conduit is sprayed into the enclosure.

Beneath the horizontal screen may be a drain member (not shown) to act as a drain and interconnect with a drain conduit 272 (FIG. 7) through the pump 196 and outwardly to the sink drain or the like 274. The arrangement of this drain should be disposed beneath the horizontal screen 26 so as to catch all liquid draining from the dishwasher and not to impinge upon the various pumps and valves located below the screen 26 and within the lower housing 12. The conduit pipes may extend through the space between the housing 16 and the screen 26.

It should also be noted that each enclosure 36 has a slot 273 along one side 275 (FIG. 2), so that the member 120 engaging the platform 126 can move it upwardly and downwardly along the vertical height of the enclosure 36. It should also be noted that the member 128 does not pivot downwardly, as that would not enable the lever arms 80, 82, 84, 86, 88, and 90 to raise and lower the enclosure bottoms 126.

It should also be noted that the controls for selecting both the pressure and the water temperature 208 and 210, respectively, may be located on the table top 14 (FIG. 1).

In operation, the user opens the door 74 of the dome 70 and disposes within a selected enclosure 36 dishes or the like. These will rest on the platform or base 126. To initiate or enable the operation of the unit, pressure is placed upon the base 126. This causes the closing of the switch 184. Each enclosure base 126 of the dishwasher has its own switch 184 coupled, in turn, electrically to its own rocker motor 138. As a consequence, each rocker motor 138 is enabled by closing the platform switch 184 associated with it. Once the door 74 is closed, electrical energy is coupled from the source 178 through line 182, the switch 184, the motor 138, line 183, line 186, and switch 188 to the pump 196. The other side of the pump 196 is coupled to ground 179. The pump 196 will only be activated upon the closing of a platform switch 184 and the door switch 188. This causes the pump 196 to open the drain 272 and pump out any liquid that may have remained in the dishwasher from a previous cycle. (A separate switch may be provided to inactivate the pump 196, if desired). At this time, the indicator 202 of the soap is activated. With the closing of at least one platform switch 184 and the door switch 188, power is provided along line 206 to the three position switches 216 and 218 and to the valve 222 and variable delivery pump 220. The three position switch 218 associated with the valve 222 enables the user to select the amount of hot water to be mixed with the cold water. The three position switch 216 connected to the variable delivery pump 220 enables the user to select the amount of pressure with which water is delivered to the system.

At the same time energy is applied to the rocker arm motor 138 associated with one of the lever arms 84, the armature 140 begins to turn and the gear moves downwardly. As a result of it moving downwardly, the platform 126 begins to be lowered. At its lowest point, bosses 156 and 146 engage the water switch and soap switch 158 and 148, respectively, causing the valve 222, variable delivery pump 220, and valve 160 to be turned on by virtue of the closing of the switch contacts 226 and 238 providing the electrical energy along lines 232, 242, and 248. In addition, the soap switch 148 closes by the closing of contacts 242 and 228 putting electrical power on line 224 to the three-way valve 150 and the variable delivery pump 246 to pump the liquid soap from the container 204. Thus, both water and soap pass through the three-way valve 150 to the cleaning station 36.

Water is directed along conduits 250 and 252, 254, 256, 258, 264, 266, 268, and 270, and soap along conduits 260, 262, 264, 266, 268, and 270 to wash the objects placed within the enclosure 36. At its lowest point, the gear begins to turn upwardly to the rocker arm motor operation. As it rotates back through the cycle, the switch contacts 148, 228, 238, and 226 open. The soap variable delivery pump 246 is turned off and the soap entry port of the three-way valve 150 closes. The water port of the three-way valve 150 and the valve 160 remain open. When the switch 158 opens, the valve 160 and three-way valve 150 are turned off. At that juncture, the contacts 234 and 224 of the fan and heating switch 170 close, thereby providing current along lines 232, 236 to the motor 172 which turns on the fan 58 and the heating element 60 to dry the dishes. It is clear that any time the door 74 of the dome 70 opens, the circuit will be disconnected and all operation will cease.

It will be understood that the term "dishes", as used herein, refers generally to all types of dishes, crockery, utensils, pots, etc. used and ordinarily placed in a dishwasher.

It will be appreciated that the operation of the dishwasher is dependent upon the closing of at least one platform switch 184 and the door switch 188. When the lever arm 84 moves to a predetermined height at the close of the washing cycle, the platform switch 184 opens, terminating all power to all pumps and valves.

What is claimed:

1. A dishwasher of the type intended to receive therein and wash dishes and including a source of electrical power, said dishwasher comprising:
   (a) a housing; said housing comprises a plurality of dish-receiving compartments;
   (b) means within said housing for washing dishes so as to act upon dishes within said compartments;
   (c) means for selectively coupling said washing means to at least a predetermined one of said compartments; and
   (d) means for operating said dishwasher upon condition that said coupling means having first coupled said washing means to said compartment.

2. A dishwasher as recited in claim 1 wherein said coupling means being capable of selectively coupling said washing means to a predetermined plurality of said compartments.

3. A dishwasher as recited in claim 2 wherein each of said compartments comprises a vertically disposed enclosure for receiving dishes and a movable support platform for receiving and supporting thereon the dishes, said platform being movable with respect to said vertical enclosure such that in a first position said platform causing said coupling means to couple said washing means to said compartment.

4. A dishwasher as recited in claim 3 wherein said first position being a lowermost position of said platform with respect to said enclosure.

5. A dishwasher as recited in claim 4 further comprises means for raising said platform from said lowermost position to a raised position, said movement occurring during the washing by said washing means.

6. A dishwasher as recited in claim 5 wherein said means for raising said platform comprises motor means and a lever arm, one end of said lever arm engaging said platform, the opposed end of said lever engaging said motor means, said motor means moving said lever arm.

7. A dishwasher as recited in claim 6 wherein said coupling means comprises at least one platform switch means mechanically closable by said lowering of one of said platforms to said lowermost position, said operating means comprises a door switch, said platform switch being in series with said door switch and said motor means and the source of power; such that, upon lowering of said platform to said lowermost position, said platform switch closes, closing said door and switch to thereby couple the electrical power source to said motor means to cause said motor means to operate.

8. A dishwasher as recited in claim 7 wherein said motor means comprises gear means for engaging said lever; said washing means comprises liquid conduit means for channeling at least a liquid to said compartments and pump means for moving the liquid; said washing means further comprises an electrical pump switch for coupling the source of electrical power for selectively operating said pump means; said gear, upon turning, engaging said pump switch at a predetermined time to thereby cause said pump means to be operable to thereby cause said liquid pump to pump liquid to said one compartment.

9. A dishwasher as recited in claim 8 further comprises a plurality of said platform switches, each electrically coupled in parallel to one another, said operating switch electrically coupling the source of power in series to one side of said platform switches, each platform switch coupling said power to a respective one of said motor means; each of said compartments having a respective lever arm, motor means, and pump switch.

10. A dishwasher as recited in claim 9 wherein said washing means further comprises means for channeling soap, said soap channeling means comprises an electrically operated soap switch each in operative relationship with each of said gears, soap conduit means, and a soap pump in line with said soap conduit and coupled to said soap switches such that, upon engagement by one of said gears, said soap pump being capable of pumping soap through said soap conduit to said compartment with which said motor gear is coupled.

11. A dishwasher as recited in claim 7 wherein said washing means further comprises means for channeling soap for washing the dishes, said soap channeling means comprises conduit means coupled to said liquid conduit and at least one soap pump in series with said soap conduit and an electrical soap switch for coupling the source of power to said pump; said soap switch being positioned to be engaged by said gear upon said motor.

12. A dishwasher as recited in claim 11 wherein said compartments further comprise a horizontal screen, each enclosure comprises vertically extending screen walls resting upon said horizontal screen, said horizontal screen being secured to said housing; said vertical walls of said compartment having a vertically extending slot therein so dimensioned as to receive therein said lever arm, said lever arm being capable of moving said platform from said lowermost position to said raised position.

13. A dishwasher as recited in claim 12 wherein each of said lever arms comprises an articulated link at the end engaging said platform such that said platform remains substantially vertical as said lever arm moves up or down with reference to said enclosure, said motor means comprises a rocker arm motor, said gear comprises a substantially elliptical gear secured to said motor armature, said gear comprising gear teeth and engaging the opposed free end of said lever arm, said free end of said lever arm having gear teeth to form, in combination with said elliptical gear, a rack and pinion, said rocker motor turning off upon raising said platform to said upper position, said gear having thereon a plurality of bosses for engaging said liquid and soap switches at predetermined times and holding said switches on to thereby cause said washing means to operate.

14. A dishwasher as recited in claim 13 wherein said lever arms further comprise a common pivot bar, said lever arms being pivotally secured adjacent to said free ends.

15. A dishwasher as recited in claim 14 wherein said liquid conduit means comprises a first and second main conduit for channeling hot and cold water, respectively; a first hydraulic valve for receiving at its input ports said first and second conduits; an output main conduit from said first valve; a first variable delivery pump for receiving said output main conduit; a manifold in communications with the output ports of said first variable delivery pump; said first variable delivery pump being capable of channeling liquid to said manifold; a plurality of second water valves, at least one of said second valves for each of said compartments; a plurality of three-way valves, at least one three-way valve for each of said compartments; said second valve coupling one of said manifold lines to one port of one of said three-way valves; said soap pump comprises a variable delivery pump; a manifold coupled to said soap pump and to said three-way valves; a container for holding liquid soap coupled to the input of said soap pump; the output of said three-way valve being coupled to said compartment; said dishwasher further comprises a housing dome, a door pivotally secured to said dome for entrance to said housing; said operating switch being closed upon closing of said door; the source of power being electrically coupled through said operating switch via each of said platform switches to said motors and to said door switch.

16. A dishwasher as recited in claim 15 wherein said dishwashing means further comprises means for drying dishes.

17. A dishwasher as recited in claim 7 wherein said dishwashing means further comprises means for drying dishes.

18. A dishwasher as recited in claim 1 wherein said dishwashing means further comprises means for drying dishes.

* * * * *